US009089750B2

(12) United States Patent
Knutson et al.

(10) Patent No.: US 9,089,750 B2
(45) Date of Patent: Jul. 28, 2015

(54) BUTT-MOUNTED SHAFT EXTENSION DEVICE

(75) Inventors: Scott A. Knutson, Escondido, CA (US); Thomas Orrin Bennett, Carlsbad, CA (US); Christopher D. Harvell, Escondido, CA (US)

(73) Assignee: Acushnet Company, Fairhaven, MA (US)

( * ) Notice: Subject to any disclaimer, the term of this patent is extended or adjusted under 35 U.S.C. 154(b) by 143 days.

(21) Appl. No.: 13/609,313

(22) Filed: Sep. 11, 2012

(65) Prior Publication Data

US 2014/0073448 A1 Mar. 13, 2014

(51) Int. Cl.

| | |
|---|---|
| ***A63B 53/16*** | (2006.01) |
| ***A63B 53/10*** | (2015.01) |
| *A63B 53/12* | (2015.01) |
| *A63B 53/14* | (2015.01) |
| *A63B 59/00* | (2015.01) |

(52) U.S. Cl.

CPC ..... *A63B 53/10* (2013.01); *A63B 53/12* (2013.01); *A63B 53/145* (2013.01); *A63B 53/16* (2013.01); *A63B 2059/0085* (2013.01)

(58) Field of Classification Search

CPC ..... A63B 2059/0085; A63B 53/10; A63B 53/16; A63B 53/145; A63B 53/12

USPC ..... 473/296–299, 239; 403/377–379.6, 403/109.1–109.8

See application file for complete search history.

(56) References Cited

U.S. PATENT DOCUMENTS

| | | | | |
|---|---|---|---|---|
| 1,557,156 | A | 10/1925 | Gless | |
| 1,613,360 | A | 1/1927 | Rigby | |
| 1,634,082 | A | 6/1927 | Rigby | |
| 1,634,887 | A | 7/1927 | Rigby | |
| 1,648,806 | A * | 11/1927 | Hadden | 473/296 |
| 1,665,811 | A * | 4/1928 | Hadden | 473/306 |
| 2,475,927 | A | 5/1945 | Verderber | |
| 2,446,622 | A | 8/1948 | Turner | |
| 2,468,202 | A | 4/1949 | Karns | |
| D160,396 | S | 10/1950 | Karns | |
| 2,604,660 | A | 7/1952 | Karns | |
| 2,604,661 | A | 7/1952 | Karns | |
| 2,704,668 | A | 3/1955 | Park | |
| 3,516,697 | A | 6/1970 | Hahn | |
| 3,539,185 | A | 11/1970 | Andis | |
| 4,826,168 | A * | 5/1989 | McGuire et al. | 473/295 |
| 5,024,438 | A | 6/1991 | Candow | |
| 5,294,117 | A | 3/1994 | Huang | |
| 5,390,921 | A | 2/1995 | DeRuyter | |
| 5,584,096 | A | 12/1996 | Aurora | |
| 5,626,527 | A | 5/1997 | Eberlein | |
| 5,649,870 | A * | 7/1997 | Harrison | 473/239 |
| 6,196,930 | B1 | 3/2001 | Aumock | |

(Continued)

FOREIGN PATENT DOCUMENTS

GB 2309389 7/1997

*Primary Examiner* — Stephen Blau

(74) *Attorney, Agent, or Firm* — Kristin D. Wheeler

(57) ABSTRACT

A device designed for modifying the length of a golf club shaft. The device is a three-piece mechanism with a bottom part bonded into the top end of a tubular golf club shaft, a top part provided within the grip, a threaded screw provided within the top part and threadably connected to the bottom part such that movement of the screw will adjust the distance between the top part and bottom part thereby adjusting the club length. The extension device is hidden within the shaft and grip and does not require a custom grip or shaft.

11 Claims, 6 Drawing Sheets

(56) References Cited

U.S. PATENT DOCUMENTS

| | | | | |
|---|---|---|---|---|
| 6,413,168 | B1 | 7/2002 | McKendry | |
| 6,511,386 | B1 | 1/2003 | Cacicedo | |
| 7,018,302 | B2 | 3/2006 | Jacoby | |
| 7,159,451 | B2 | 1/2007 | McGann et al. | |
| 7,250,005 | B2 | 7/2007 | Wood et al. | |
| 7,261,641 | B2 | 8/2007 | Lindner | |
| 7,422,526 | B2 * | 9/2008 | Nemeckay | 473/296 |
| 7,448,958 | B2 * | 11/2008 | Huang | 473/300 |
| 7,611,422 | B2 | 11/2009 | Hocknell et al. | |
| 7,699,718 | B2 | 4/2010 | Lindner | |
| 7,704,161 | B2 | 4/2010 | Lindner | |
| D622,341 | S | 8/2010 | Pepin | |
| 8,491,408 | B2 * | 7/2013 | Beach et al. | 473/296 |
| 2003/0148819 | A1 | 8/2003 | Lindner | |
| 2005/0143186 | A1 | 6/2005 | Blattnet et al. | |
| 2009/0270197 | A1 * | 10/2009 | Holtzman | 473/296 |
| 2011/0256949 | A1 | 10/2011 | Soracco et al. | |

* cited by examiner

BUTT-MOUNTED SHAFT EXTENSION DEVICE

FIELD OF THE INVENTION

The present invention relates generally to a device for adjusting the length of a golf shaft. In particular, the invention concerns modifying the length of the shaft by utilizing the device at the gripping end of the club that is not visible and does not require a special grip or shaft.

BACKGROUND OF THE INVENTION

One of the more important factors in golf club equipment is the club shaft. The shaft transfers the golfer's power to the club head. Golf club shafts are available in various types of materials and structures. Steel shafts are stronger, last longer, more durable and generally less expensive than graphite or carbon fiber shafts, and are usually made from carbon steel, although stainless steel is sometimes used. The steel shafts are available in stepped or rifle designs. The graphite shafts are more expensive and less durable; however, the lighter weight creates greater swing speed for more power. Also available are multi-material and titanium shafts.

When installing a shaft, the proper length must be accurately determined. The length can be as important to a golf shaft as is the flex or torque. Most measurements of the correct shaft length for the player involve a determination of a particular player's height and distance of his hands to the floor. Shaft length will impact whereon the clubface the ball will be consistently struck, and often, an incorrect shaft length is the main cause of a golfer to alter his natural swing arc in order to make optimum impact. According to most research, if ball impact is but one inch off-center this can equate to a 14% loss of carry distance, so it is vitally important that the length of the club be accurately fitted for each particular player.

If it is seen in the fitting process that a player needs to adjust his club length, such as adding or removing a half inch, inch or two inches to the length of the club, it would be highly desirable to lengthen his present club(s) rather buy and install new shafts. Typical driver shaft lengths are from 43 to 47 inches.

Prior art shafts having adjustable lengths have been used for many years for a wide variety of applications. Each of these applications has its own functional and aesthetic requirements for the shaft construction which is employed. As a consequence, a number of different mechanisms and devices have been developed to satisfy the particular application requirements. A majority of golf club shaft extension patents are directed to use mainly as putters, or to extending shafts of an existing set of clubs to accommodate growing children. While the teachings of the present invention may be adapted to these types of applications, the focus is rather to make a club adjustment that is rigid, secure, and easily fastened. Additionally, the ability to adjust the shaft length without the need for a custom grip or a custom made shaft is desirable along with the device being hidden within the shaft and grip such that it is not distracting to the player.

BRIEF SUMMARY OF THE INVENTION

The present invention provides for an extension device for use on the butt-end of a golf club shaft. The device consists of three basic parts: an upper part; a lower part; and a connecting device. The bottom part is secured into the tubular opening in the top of the club shaft. A connecting device is provided within the upper part and extending from a second end of the upper part, a distal portion of the connecting device is threadably connected to the lower part. The connecting device is engageable to adjust the position of the lower part relative to the upper part.

In another embodiment, an extension device is provided for use on a butt-end of a golf club shaft. The extension device comprises a grip secured to an upper end of a golf club shaft where the top end of the grip has a threaded cavity. A plurality of grip inserts having different lengths is provided. The inserts have threaded protrusions. The grip insert having the desired length may be selected, whereby the threaded protrusion of the grip insert engages the threaded cavity of the grip such that the grip insert is secured to the grip resulting in a club that has a desired length.

The invention can be used to extend or shorten any of the golf clubs in a set, but preferably is designed for use with a driver.

These and other features, aspects and advantages of the present invention will become better understood with reference to the following drawings, description and claims.

BRIEF DESCRIPTION OF THE DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features. However, any single inventive feature may not address any or all of the problems discussed above or may only address one of the problems discussed above. Further, one or more of the problems discussed above may not be fully addressed by any of the features described below.

Figure 1:
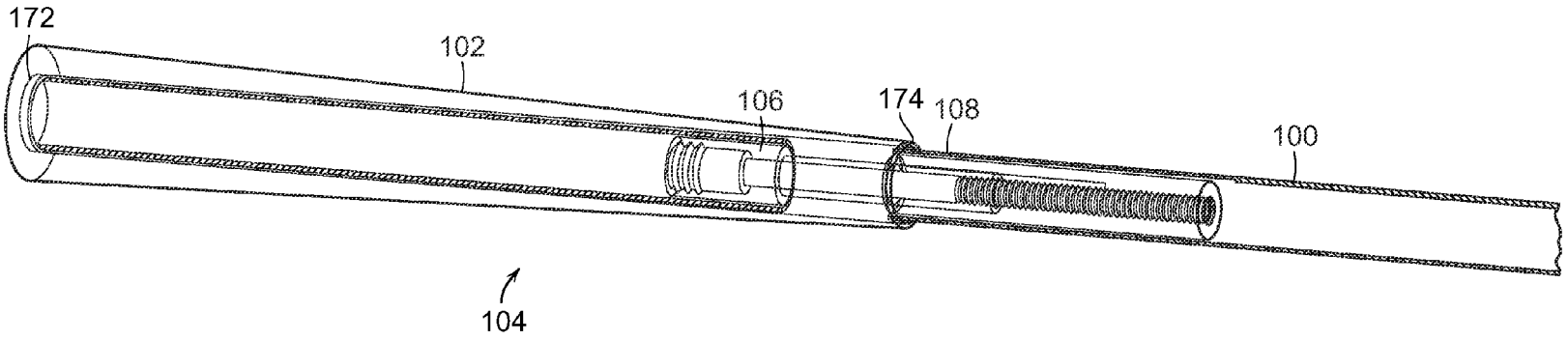
FIG. 1 is a perspective view of a golf club grip, shaft and shaft extension device in accordance with an exemplary embodiment of the present invention and showing all of the assembled internal parts.

FIG. 1 of the accompanying drawings shows a golf club shaft 100 and grip 102 having an extension device 104 provided on a golf club head (not shown) according to the present invention. The extension device 104 allows the shaft to be telescopically inserted further under the grip 102 to shorten the overall length of the golf club by shortening the length of exposed shaft 100 extending from the grip 102. It will be appreciated that the extension device 104 also allows the shaft's 100 length to be lengthened by sliding the shaft 100 further out from the grip 102 to lengthen the exposed shaft 100 extending from the grip 102. No special custom grip or shaft is required to operate or use the extension device 104.

Figure 2:
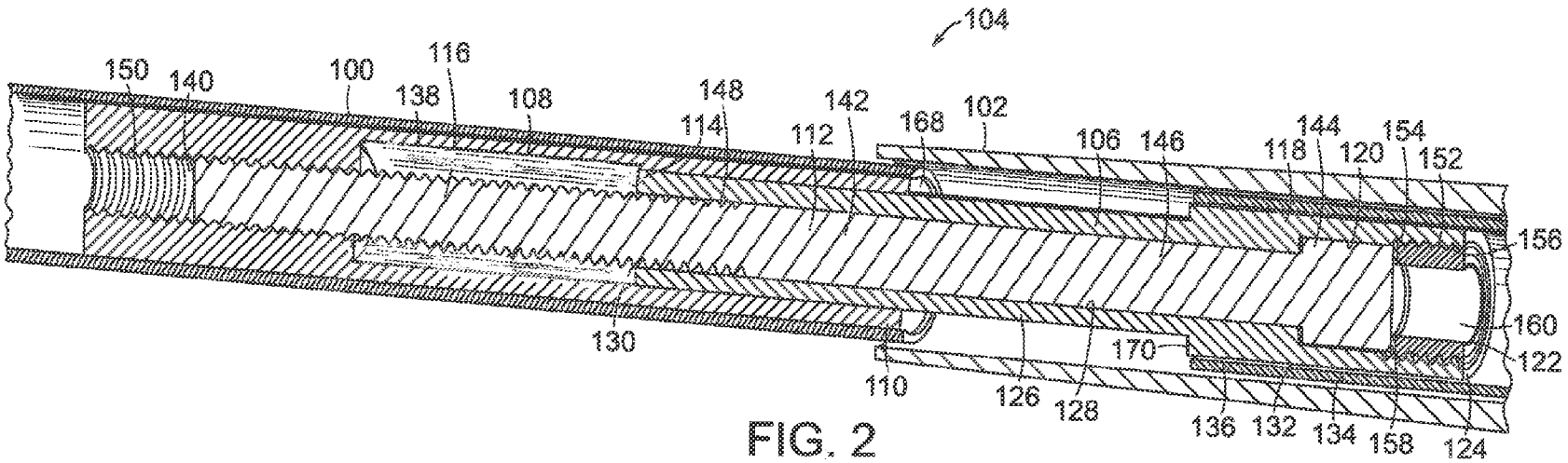
FIG. 2 is a perspective three-dimensional cross-sectional view of the grip, shaft and shaft extension device according to the embodiment of FIG. 1.
Figure 3:
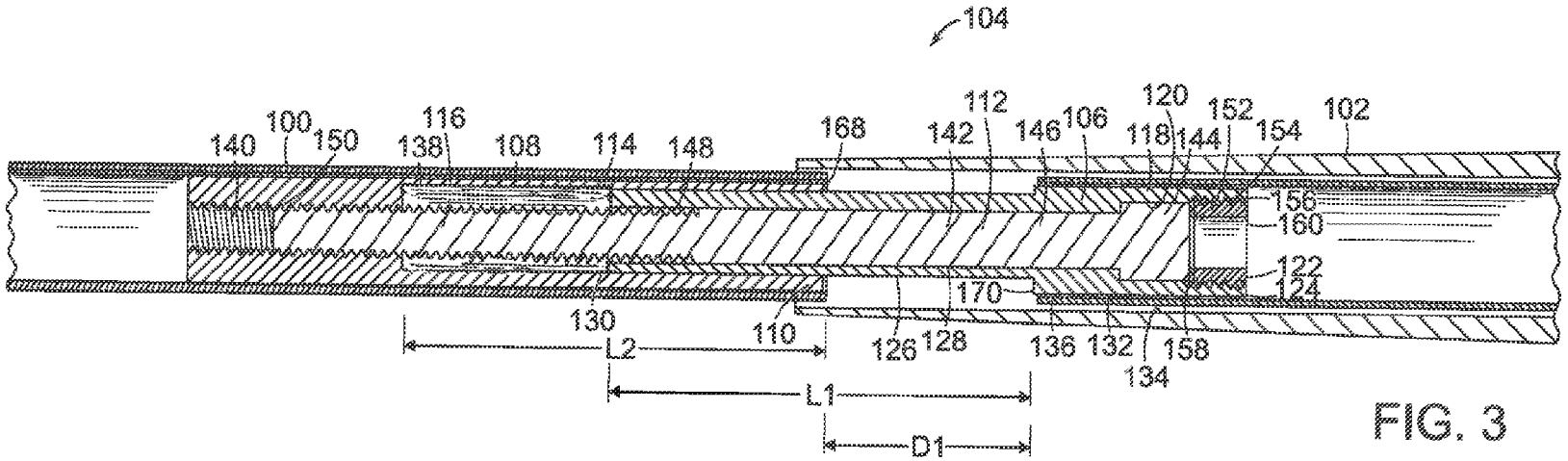
FIG. 3 is a cross-sectional view of the grip, shaft and the shaft extension device according to the embodiment of FIG. 1.

FIGS. 2 and 3 illustrate the extension device 104 provided within the grip 102 and shaft 100. The extension device 104 is for use on a butt-end of the golf club shaft 100 and comprises an upper part 106 provided in the grip 102 and a lower part 108 provided in an upper tubular opening 110 of the golf club shaft 100. A connecting device 112 is provided within the upper part 106 and extends from a second end 114 of the upper part 106, and has a distal portion 116 of the connecting device 112 threadably connected to the lower part 108. The connecting device 112 is engageable to adjust the position of the lower part 108 relative to the upper part 106.

The upper part 106 has a first portion 118 with a first cavity 120 extending from an opening 122 at a first end 124 and a second portion 126 with a second cavity 128 that extends along the length of the upper part 106 from the first cavity 120 through the second portion 126 to an opening 130 at the second end 114 of the upper part 106. The first portion 118 has an outer surface 132 that is connected to an inner surface 134 of the grip 102. Preferably the outer surface 132 of the upper part 106 is secured within a second shaft portion 136 provided within the grip 102. This second shaft portion 136 is then secured to the inner surface 134 of the grip 102. As will be appreciated, adhesive, glue or other means may be used to secure the upper part 106 to either the grip 102 or second shaft portion 136 and the second shaft portion 136 to the grip 102. The second portion 126 of the upper part 106 remains unconnected to the grip 102, and when a second shaft portion 136 is provided, the second portion 126 extends beyond the second shaft portion 136.

The lower part 108 has an upper cavity 138 extending along its length that receives the second portion 126 of the upper part 106 and a lower threaded cavity 140 that extends along the length of the lower part 108 from the upper cavity 138. The lower part 108 is provided within the upper tubular opening 110 of the golf club shaft 100. Preferably the lower part 108 is secured within the golf club shaft 100 using adhesive or glue or other suitable means. The second portion 126 of the upper part 106 is at least partially slidably inserted into the upper cavity 138 of the lower part 108.

The connecting device 112 is provided in the first cavity 120 of the first portion 118 of the upper part 106 and extends through the second cavity 128 of the second portion 126 of the upper part 106, through the upper cavity 138 of the lower part 108 and into the threaded lower cavity 140 of the lower part 108. Preferably, the connecting device 112 is a threaded screw 142 having a head 144 and a body 146, the body 146 at least partially having threads 148 to engage with threads 150 of the threaded lower cavity 140 of the lower part 108. The head 144 fits within the cavity 120 of the first portion 118 of the upper part 106 and is prevented from exiting the upper part 106 by a threaded member 152 that engages threads 154 on sidewalls 156 of the cavity 120 to prevent movement of the screw 142 out of the upper part 106. A wave washer, nylon or delrin spacer 158 may be provided between the threaded member 152 and the head 144 of the screw 142. The threaded member 152 has an opening 160, such that a tool (not shown) may be engaged with the head 144 of the screw 142 for turning the screw 142 to engage it with the threads 150 in the threaded lower cavity 140 of the lower part 108.

Figure 4:
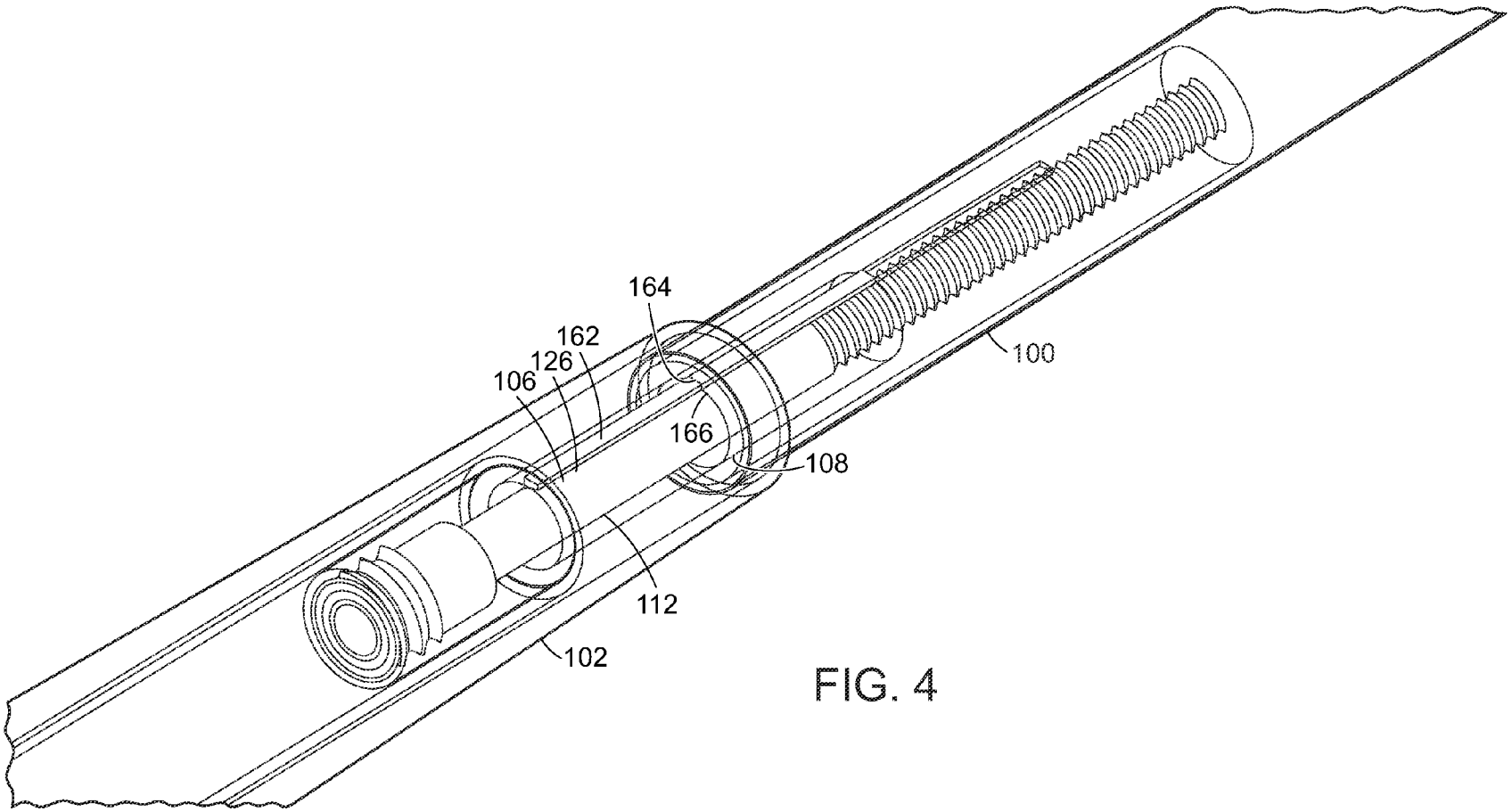
FIG. 4 is perspective view of a portion of the grip, shaft and the shaft extension device showing all of the assembled parts according to the embodiment of FIG. 1.
Figure 5:
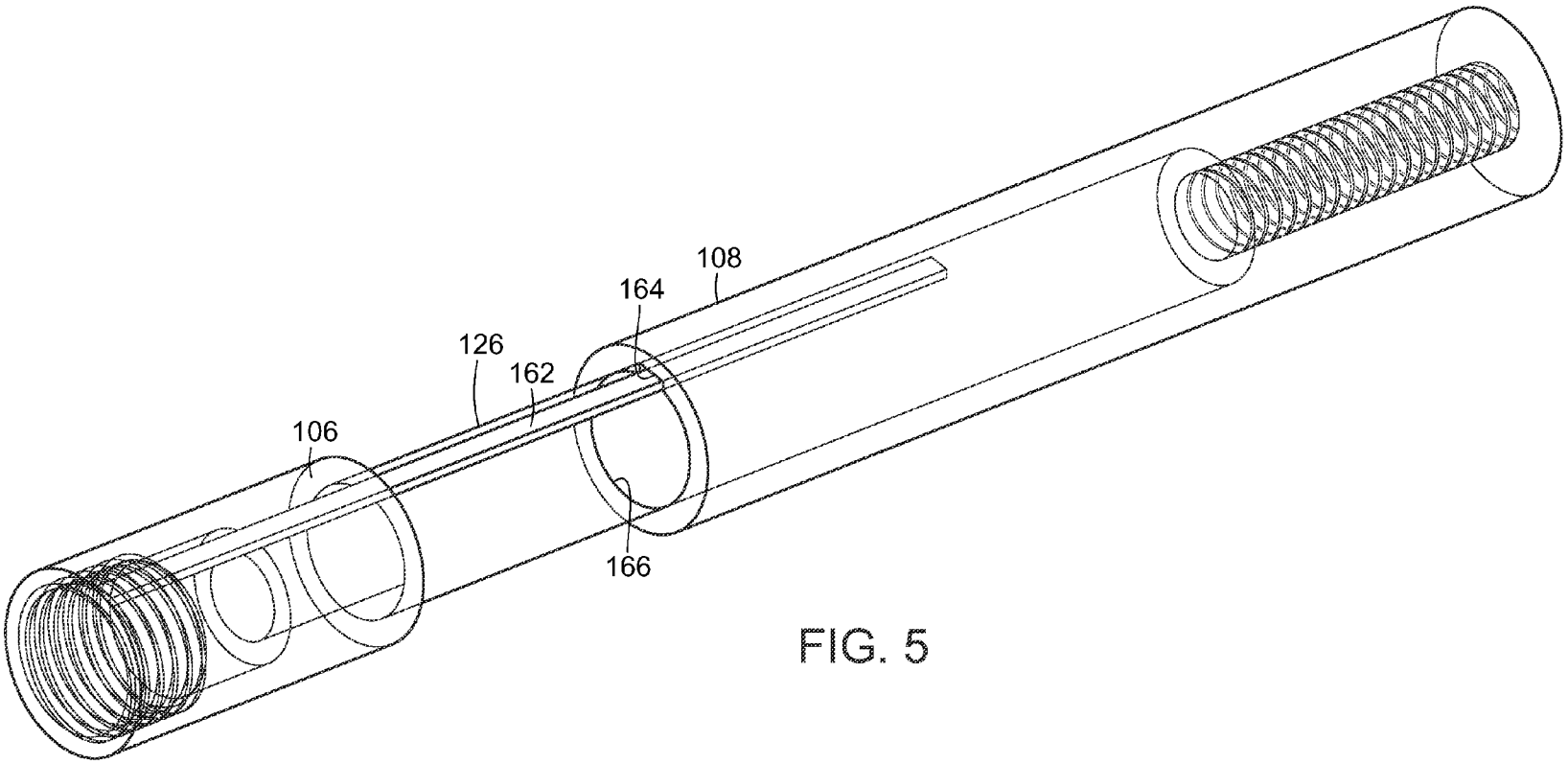
FIG. 5 is perspective view of the upper part and lower part of the shaft extension device according to the embodiment of FIG. 1.

As illustrated in FIGS. 4 and 5, the second portion 126 of upper part 106 preferably includes at least one protrusion 162 provided along its length. This protrusion 162 is matingly received by a reciprocal slot 164 provided on an inner surface 166 of the upper cavity 138 of the lower part 108. The engagement of the protrusion 162 in the slot 164 prevents rotation between the upper part 106 and the lower part 108. It will be understood that more than one set of mating protrusions 162 and slots 164 may be provided on the extension device 104.

Referring now to FIGS. 2 and 3, by tightening or loosening the screw 142, the distance between a first end 168 of the lower part 108 and the second end 170 of the first portion 118 of the upper part 106 may be adjusted. Engaging the screw 142 further into the threaded cavity 140 of the lower part 108 will slide the shaft 100 and lower part 108 further under the grip 102 to shorten the overall golf club shaft 100 length. As illustrated in FIG. 3, the second portion 126 of the upper part 106 has a distance L1 and the upper cavity 138 of the lower part 108 has a length L2, preferably L1 and L2 are substantially the same, such that substantially the whole of the second portion 126 of the upper part 106 may be fit within the upper cavity 138 of the lower part 108. By moving the lower part 108 slidably over the upper part 106 the distance D1 between the lower end 170 of the first portion 118 of the upper part 106 and first end 168 of the lower portion 108 may be shortened or lengthened. Preferably, the distance D1 may be from 0 to 5 inches, more preferably it may be adjusted from 0 to 3 inches, still more preferably from 0 to 2 inches and most preferably from 0 to 1 inch. It will be appreciated that the distance may be adjustable in increments or continuously adjustable.

Figure 1A:
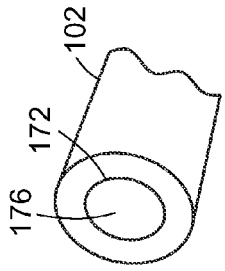
FIG. 1A is a perspective view of an end of the golf club grip according to the embodiment of FIG. 1.

It will be appreciated that the upper end 106 of the grip 102 may have an opening 172, such that a tool, such as a screw driver, may be used to engage with the screw head 146 to turn the screw 142 in the desired direction to either move the lower part 108, and thus the shaft 100, further under or out of a lower end 174 of the grip 102. This allows the length of the shaft 100 to be adjusted without having to modify the grip 102. This allows for easy adjustment of shaft 100 length without having to change the grip 102 or use a specialized grip to adjust for a change of length. As shown in FIG. 1A, the opening 172 in the upper end of the grip 102 may include a cap 176 to cover the opening 172 when adjustment of the club length is not needed. It will be appreciated that a traditional grip may use the desired cap 176. It will be appreciated that the present shaft extension device 104 may be used on any type of club, including drivers, fairways, hybrids, irons, wedges and putters.

Figure 6:
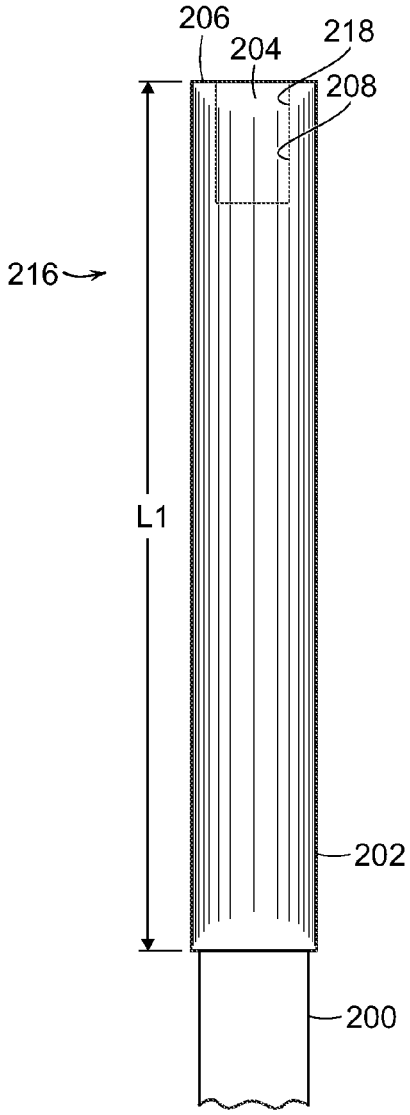
FIG. 6 is a plan view of a grip according to another embodiment of the present invention.
Figure 6A:
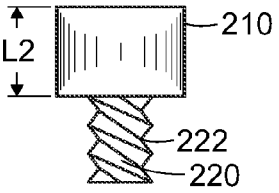
FIG. 6A is a plan view of a grip insert according to the embodiment of FIG. 6.
Figure 6B:
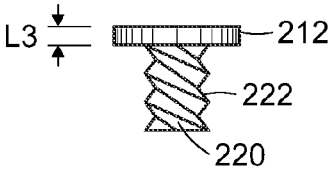
FIG. 6B is a plan view of another grip insert according to the embodiment of FIG. 6.
Figure 6C:
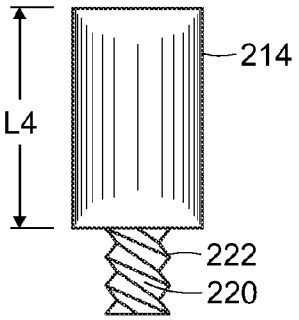
FIG. 6C is a plan view of another grip insert according to the embodiment of FIG. 6.
Figure 7:
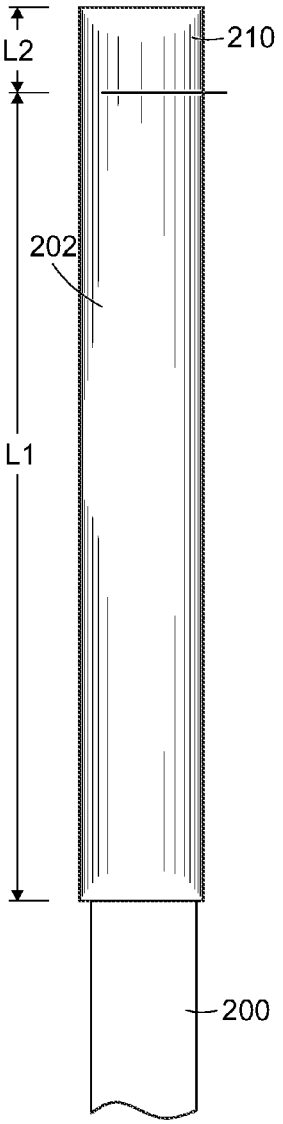
FIG. 7 is a plan view of a grip according to the embodiment of FIGS. 6 and 6A.
Figure 8:
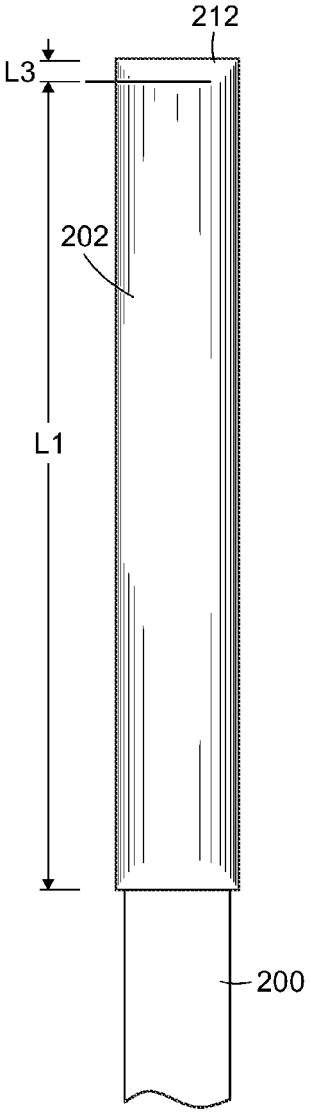
FIG. 8 is a plan view of a grip according to the embodiment of FIGS. 6 and 6B.
Figure 9:
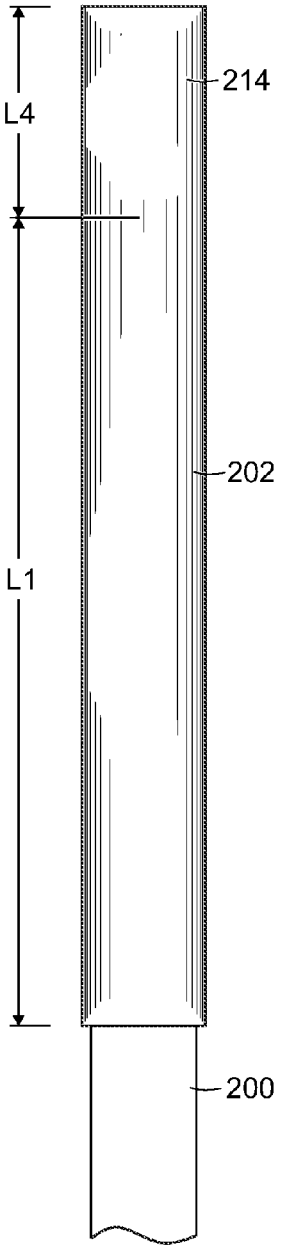
FIG. 9 is a plan view of a grip according to the embodiment of FIGS. 6 and 6C.

FIG. 6 illustrates another shaft extension device 216 design for lengthening or shortening a golf club. In this embodiment, a shaft 200 is engaged with a grip 202 in a traditional manner. The grip 202 features a cavity 204 at an upper end 206. Preferably, the cavity 204 features threaded sidewalls 208. A plurality of grip extenders or inserts 210, 212, 214 may be provided for attachment to the upper end 206 of the grip 202. For example, as shown in FIGS. 6A through 6C, three different sized grip inserts 210, 212 and 214 are provided. The first grip insert 210 has a length L2, the second grip insert 212 has a length L3 and the third grip insert 214 has a length L4. The grip 202 has a length L1. A grip insert 210, 212 and 214 may be selected to be attached to the grip 202 to provide a desired length golf club. For example, as shown in FIG. 7, the length L1 of the grip 202 with the grip insert 210 having a length L2 may together form a desired length club. As illustrated in FIG. 8, the length L1 of the grip 202 with the grip insert 212 having a length L3 may together form a shorter length club. Finally, as illustrated in FIG. 9, the length L1 of the grip 202 with the grip insert 214 having a length L4 may together form a longer length club. It will be appreciated that more than three shaft grip inserts 210, 212 and 214 may be provided to modify the overall length of the club. It will be appreciated that the lengths L1, L2, L3 and L4 may be any desired lengths. In a preferred embodiment, the length L2 brings the club to a standard length club, while the length L3 shortens the club length by 0.5 to 2 inches and the length L4 lengthens the club length by 0.5 to 2 inches. Most preferably, the grip insert 212 with a length L3 shortens the club length by 0.5 inches, while the grip insert 214 with a length L4 lengthens the club by 0.5 inches. It will be appreciated that the present grip extension device 216 may be used on any type of clubs, including drivers, fairways, hybrids, irons, wedges and putters.

It will be appreciated that any means of attachment may be used to secure the grip inserts 210, 212 and 214 to the upper end 206 of the grip 202. In a preferred embodiment, the cavity 204 in the grip 202 features threaded sidewalls 218 and the grip inserts 210, 212 and 214 have extensions 220 with reciprocating threads 222 that engage with the sidewall threads 218 to removably secure the grip insert 210, 212 and 214 to the grip 202. Alternatively, the grip inserts 210, 212 and 214 and grip cavity 204 may feature a snap-fit feature or other mechanism to secure the grip inserts 210, 212 and 214 to the grip 202. It will be appreciated that a change in swing weight with the different grip inserts 210, 212 and 214 may be accounted for by having the grip inserts 210, 212 and 214 be different weights by using different materials of different densities or by the construction of the grip inserts 210, 212 and 214 by making them hollow or filled. Additionally, the grip inserts 210, 212 and 214 may accommodate different weight mechanisms so that the grip inserts 210, 212 and 214 may additionally add or remove weight from the grip 202. Generally the mass of the inserts may alter the weight of the grip by 1 to 60 grams, preferably between 5 and 40 grams. Additionally or alternatively, the club head itself may be designed such that it has adjustable weights.

Unless otherwise expressly specified, all of the numerical ranges, amounts, values and percentages may be read as if prefaced by the word "about" even though the term "about" may not expressly appear in the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting form the standard deviation found in their respective testing measurements. Furthermore, when numerical ranges of varying scope are set forth herein, it is contemplated that any combination of these values inclusive of the recited values may be used.

It should be understood, of course, that the foregoing relates to exemplary embodiments of the present invention and that modifications may be made without departing from the spirit and scope of the invention as set forth in the following claims.

What is claimed is:

1. An extension device for use on a butt-end of a golf club shaft, comprising:

an upper part having first and second ends and a first portion having a first and second end;

a lower part provided in an upper tubular opening of the golf club shaft; and a connecting device provided within the upper part and extending from a second end of the upper part, a distal portion of the connecting device threadably connected to the lower part;

wherein the connecting device is engageable to adjust the position of the lower part relative to the upper part, and wherein the first portion of the upper part is secured to an inner surface of a grip and a second portion of the upper part remains unconnected to the grip, and wherein at least a portion of the second portion of the upper part is provided within a first end of the lower part, the lower part being slidable over the second portion of the upper part, such that engagement of the connecting device adjusts a distance between the first end of the lower part and the second end of the first portion of the upper part.

2. The extension device of claim 1, further comprising a second shaft portion provided between the first portion of the upper part and the grip.

3. The extension device of claim 2, wherein the grip, second shaft portion and upper part are secured using an adhesive.

4. The extension device of claim 1, wherein the distance is adjustable between 0 and 5 inches.

5. The extension device of claim 4, wherein the distance is adjustable between 0 and 2 inches.

6. The extension device of claim 5, wherein the distance is adjustable between 0 and 1 inch.

7. The extension device of claim 1, further comprising at least one protrusion provided along the length of the second portion of the upper part and at least one slot provided along an interior surface of a first portion of the lower part, the protrusion engaging with the slot to keep the upper part and lower part from rotating relative to one another.

8. The extension device of claim 1, wherein the connecting device is an elongate screw provided through a cavity in the upper part, the lower part has a first portion and a second portion, the screw extending from the upper part and threadably engaging a cavity provided in the second portion of the lower part.

9. The extension device of claim 8, further comprising a threaded member provided at a first end of the first portion of the upper part to secure the elongate screw within the first portion.

10. The extension device of claim 8, wherein the grip has an opening at a top end such that a tool is able to engage a head of the screw to move the lower part relative to the upper part.

11. The extension device of 10, wherein the top end of the grip has a removable cover provided on the opening.

* * * * *